US012709956B1

(12) United States Patent
McCormick et al.

(10) Patent No.: US 12,709,956 B1
(45) Date of Patent: Aug. 18, 2026

(54) JARRING DEVICE

(71) Applicant: Petromac IP Limited, Auckland (NZ)

(72) Inventors: Stephen Peter McCormick, Auckland (NZ); Edward Harrigan, Richmond, TX (US)

(73) Assignee: Petromac IP Limited, Auckland (NZ)

( * ) Notice: Subject to any disclaimer, the term of this patent is extended or adjusted under 35 U.S.C. 154(b) by 0 days.

(21) Appl. No.: 19/349,114

(22) Filed: Oct. 3, 2025

Related U.S. Application Data

(60) Provisional application No. 63/850,769, filed on Jul. 25, 2025.

(51) Int. Cl.
*E21B 31/113* (2006.01)

(52) U.S. Cl.
CPC ..... *E21B 31/1135* (2013.01)

(58) Field of Classification Search
CPC ..... E21B 31/1135
See application file for complete search history.

(56) References Cited

U.S. PATENT DOCUMENTS

| | | | | |
|---|---|---|---|---|
| 5,392,623 | A * | 2/1995 | Cueman | B21B 21/005 72/11.2 |
| 6,866,096 | B2 | 3/2005 | Tillett, Jr. | |
| 9,631,446 | B2 | 4/2017 | Hradecky | |
| 10,151,165 | B2 | 12/2018 | Evans | |
| 10,190,394 | B2 | 1/2019 | Guo | |
| 11,506,011 | B2 | 11/2022 | Al-Mousa | |
| 12,305,506 | B1 * | 5/2025 | Cook | E21B 47/026 |
| 2016/0258254 | A1 * | 9/2016 | Guo | H02K 35/02 |

FOREIGN PATENT DOCUMENTS

| | | | | |
|---|---|---|---|---|
| CA | 2487222 C * | 4/2008 | | E21B 44/00 |

* cited by examiner

*Primary Examiner* — Caroline N Butcher
(74) *Attorney, Agent, or Firm* — Niels Haun; Dann, Dorfman, Herrell & Skillman, P. C.

(57) ABSTRACT

A jar for providing an impact to a tool string stuck in a wellbore comprises a housing and a mandrel configured to move relative to the housing, and a release mechanism actuatable to fire the jar to cause the housing and mandrel to collide by the action of an applied tension to cause an impact to the tool string. The jar further comprises a transducer configured to measure the axial position of the mandrel relative to the housing to allow for a real-time measurement of the jar status at the surface based on the measured axial position.

18 Claims, 6 Drawing Sheets

JARRING DEVICE

RELATED APPLICATIONS

This application claims benefit of Provisional Application No. 63/850,769 filed on Jul. 25, 2025, entire contents of which are incorporated herein by reference.

TECHNICAL FIELD

This invention relates to a down hole jarring device for use with a tool string in a wellbore, and a related system, for providing a jar status at the surface. A jarring device is operable to provide an impact force to the tool string within the wellbore in the event the tool string becomes stuck in the well, to free the tool string for retrieval.

BACKGROUND

Jarring or impact devices used in the upstream oil and gas industry are commonly referred to as jars. Jars are installed in-line within a tool string that is lowered from a surface mounted platform, rig or other wellsite structure (herein a wellsite) into a well drilled in a subterranean formation. Example tool strings include wireline logging tool strings used to log data in newly drilled wells or cased production wells. Jars may also be deployed in drill strings during the drilling of a well.

Drilling and logging a well, for example by wireline logging, are expensive operations. When running a tool string into a well, there is a risk of the tool string becoming stuck in the well. A tool string may become stuck due to a collapsed well bore or other debris in the well, or due to other mechanical means such as differential pressure between the wellbore pressure and formation pressure. A stuck tool string can result in significant delays and therefore costs. If a stuck tool string cannot be retrieved, the tool string is lost, and the well may be abandoned or sidetracked. Such an event is catastrophic, resulting in significant financial losses.

A jarring device is included in the tool string to mitigate the risk of such losses. Should a tool string become stuck, the jarring device may be activated to provide an impact force to the tool string to free the stuck tool string.

The tool string, including the jar, is connected to surface via a wireline cable or other conveyance systems such as drill pipe or coiled tubing. Tension is applied from surface through the wireline cable to the jar. Energy is stored in the tensioned and stretched wireline cable. The tension acting on the jar is resisted by powerful springs within the Jar. As more tension is applied to the wireline cable, the springs in the jar become more compressed as a movable part of the jar moves against a stationary part of the jar. The moveable part of the jar is attached to the wireline and the stationary part of the jar is connected to the stuck tool string. The jar is "fired" by applying tension above a tension threshold. At a certain tension the relative displacement increases to trigger a release mechanism in the jar to disengage the jar springs. Upon release, the movable part of the jar rapidly accelerates and collides with the stationary part of the jar. The collision imparts a force to the tool string to 'jar' or jolt the tool string free.

Jars are either mechanical, hydraulic, or hybrid mechanical-hydraulic. Mechanical jars fire when the trigger threshold is reached. Hydraulic jars are typically configured to provide a time delay by means of a throttle restricting fluid flow, herein referred to as a hydraulic time delay. The hydraulic time delay allows tension above the trigger threshold to be applied for a period of time without the jar firing. This provides a benefit whereby high tension may be applied to the tool string to free the tool string without firing the jar. Firing a jar is a last resort as the impact applied to the tool string may damage expensive electronic components within the tool string.

A hydraulic time delay may also allow for a variable tension to be applied. A tension above a trigger threshold may be applied to the jar for a period of time without the jar firing. The tension may then be released to reset the time delay, with progressively higher tensions applied and released up to a maximum tension to attempt to free the tool string without firing. If the tool string remains stuck after applying and then releasing the maximum tension, a tension above the trigger threshold but lower than the maximum tension may be applied to fire the jar to reduce the risk of damage to the tool string. Thus the jar can be fired at any tension above the trigger threshold which provides an advantage over mechanical jars.

Regardless of the jar type-whether mechanical, hydraulic or hybrid mechanical/hydraulic, the jar is triggered or fired by applying a tension to the jar to cause the movable part of the jar to move relative to a stationary part of the jar a set distance to activate a release mechanism. Once the release mechanism activates, the movable part of the jar is released to accelerate towards and impact against the stationary part of the jar.

Due to many variables, whether a jar has fired or remains unfired is unknown. For example, in a highly deviated or deep well, the tension applied to the jar downhole may be significantly less than the tension applied to the wireline at the surface due to friction between the wireline and the wellbore wall. Although a tension above a threshold has been applied to the wireline, the jar may remain unfired. Alternatively, in some cases, a jar may accidentally fire without warning or personnel knowing the jar had fired, for example where the jar is connected to a heavy tool string. Personnel can only be certain of the state of a jar once the jar has been retrieved to the surface.

It would be useful to have a surface indication of the state of a jar e.g. fired/not fired, and/or a prior/preemptive indication or measurement of when a jar is going to fire so that the firing can be managed in a controlled and known way.

The reference to any prior art in the specification is not, and should not be taken as, an acknowledgement or any form of suggestion that the prior art forms part of the common general knowledge in any country.

DISCLOSURE OF INVENTION

It is an object of the present invention to address any one or more of the above problems or to at least provide the industry with a useful choice.

According to one aspect of the present invention there is provided a jar for providing an impact to a tool string stuck in a wellbore, the jar comprising:

- a housing and a mandrel configured to move relative to the housing, and
- a release mechanism actuatable to fire the jar to cause the housing and mandrel to collide by the action of an applied tension to cause an impact to the tool string, and
- a transducer configured to measure the axial position of the mandrel relative to the housing to allow for a real-time measurement of the jar status at the surface based on the measured axial position.

In some embodiments, the release mechanism is configured to be actuated by axial displacement of the mandrel relative to the housing by a predetermined actuation distance, and the transducer is configured to measure the axial position of the mandrel relative to the housing to allow for a real-time measurement at the surface of the jar status based on the measured axial position and the actuation distance.

In some embodiments, the transducer is configured to continuously and incrementally measure the axial position of the mandrel relative to the housing.

In some embodiments, the transducer is a linear variable differential transformer (LVDT) comprising:

a primary coil and two secondary coils mounted to the housing, and a core comprising a magnetic permeability material fixed to the mandrel and received within a bore of the coils to move axially with the mandrel therein.

In some embodiments, the core comprises a non-magnetic portion fixed to the mandrel and the magnetic permeable material mounted to the non-magnetic portion.

In some embodiments, the mandrel is hollow, and wherein the non-magnetic portion of the core is a hollow cylinder connected in-line with the mandrel, an inside of the mandrel and the core providing a conduit for electrical conductors to pass through the jar.

In some embodiments, wherein the non-magnetic hollow cylinder forms a faraday shield to prevent electrical carrying conductors passing through the transducer from interfering with a signal from the transducer.

In some embodiments, the jar comprises a compensation piston and an inside of the housing, mandrel and core is fluid filled, and the fluid is pressure compensated to an external ambient pressure by the compensation piston.

In some embodiments, the jar comprises an upper connector and a lower connector for mechanical and electrical connection to a wired conveyance system and the tool string, and electrical conductors passing through the conduit extending between the upper and lower conductors, and the electrical conductors configured to carry a signal or data from the transducer to the lower connector, and associated data or signal from the bottom connector to the upper connector for transmission to the surface.

In some embodiments, the LVDT comprises a sleeve mounted to the housing for supporting a free end of the core to slide therein, and wherein the sleeve comprises a channel or duct to route wires from the coils and LVDT to avoid contacting the moving core.

According to a second aspect of the present invention there is provided a system for providing an impact to a tool string stuck in a wellbore, the system comprising:

a jar as described in any one or more of the above statements of the first aspect of the invention, a data acquisition system to provide communication between the jar and a surface wellsite, and a surface user interface to communicate the real time measurement of the jar status at the surface based on the measured axial position.

In some embodiments, the transducer is configured to continuously and incrementally measure the axial position of the mandrel relative to the housing, and the system is configured to continuously provide the jar status real-time based on the measured axial position.

In some embodiments, the jar release mechanism is configured to be actuated by axial displacement of the mandrel relative to the housing by a predetermined actuation distance, and the system is configured to provide the real-time measurement of the jar status based on the measured axial position and the actuation distance.

In some embodiments, the system is configured to provide the real-time measurement of the jar status based on the measured axial position, a rate of axial travel of the housing relative to the mandrel and the actuation distance.

In some embodiments, the measurement of the jar status is or comprises one or more of:

a distance the mandrel has travelled or is yet to travel along the actuation distance, a distance the mandrel has travelled or is yet to travel along the actuation distance as a percentage of the actuation distance, and/or a time based on the distance the mandrel has yet to travel along the actuation distance and a rate of travel of the mandrel relative to the housing or known characteristics of the jar and an applied tension.

In some embodiments, the jar status comprises any one or more of jar fired, jar not-fired, jar cocked, jar not-cocked.

In some embodiments, the system is configured to provide the jar status as a continuously incrementing real time value and/or one or more real-time discrete visual or audible warning.

In some embodiments, the one or more warning is based on a distance and/or time threshold determined from i) when the mandrel has moved a portion of an actuation distance and/or ii) a time period based on a distance of travel of the mandrel relative to the housing, the actuation distance and a rate of travel of the housing relative to the mandrel.

According to a third aspect of the present invention there is provided a transducer for a downhole tool comprising a first part and a second part configured for relative axial movement therebetween, wherein the transducer is a linear variable differential transformer (LVDT) comprising:

a primary coil and two secondary coils adapted for connection to the first part, and a core adapted for connection to the second part, the core comprising a magnetic permeability material received within a bore of the coils to move axially therein with movement of the downhole tool second part.

In some embodiments, the transducer comprises a transducer housing adapted for connection to a downhole tool housing being the first part, the primary coil and two secondary coils mounted to the transducer housing, and the core adapted for connection to a mandrel of the downhole tool being the second part.

In some embodiments, the core comprises a non-magnetic portion fixed to the second part and the magnetic permeable material mounted to the non-magnetic portion.

In some embodiments, the non-magnetic portion of the core is a non-magnetic hollow cylinder, the core providing a conduit for electrical conductors to pass through the transducer.

In some embodiments, wherein the non-magnetic hollow cylinder forms a faraday shield to prevent electrical carrying conductors passing through the transducer from interfering with a signal from the transducer.

In some embodiments, the non-magnetic hollow cylinder is configured to be filled with a fluid pressure compensated to an external ambient wellbore pressure.

In some embodiments, the LVDT comprises a sleeve mounted to the housing for supporting a free end of the core to slide therein, and wherein the sleeve comprises a channel or duct to route wires from the coils and LVDT to avoid contacting the moving core.

The third aspect of the invention may comprise any one or more of the features described above in relation to the first or second aspects of the invention.

According to a fourth aspect of the present invention there is provided a method for firing a jar, the method comprising:

i) providing a system as described in any one of the above statements of the second aspect of the invention, and if the tool string becomes stuck in the wellbore, ii) applying a pull tension to the jar, iii) monitoring the real time measurement of the jar status to determine when the jar will fire, and continuing to apply the pull tension until the tool string is free or a hold threshold is reached, and iv) if the tool string is not free and the hold threshold is reached, applying a firing tension to the jar, wherein the firing tension is less than the pull tension, and v) firing the jar at the firing tension.

In some embodiments, if the tool string is not free after firing, then the method further comprises applying a pull tension to the jar without re-cocking the jar.

In some embodiments, if the tool string is not free after firing, the method further comprises:

vi) re-cocking the jar, vii) determining an updated firing tension, and viii) firing the jar at the updated firing tension.

In some embodiments, the updated firing tension is higher than a previous firing tension.

In some embodiments, if the tool string is not free after firing at the updated firing tension, the method further comprises refiring the jar at progressively higher firing tensions up to a maximum allowable firing tension or until the tool string is free.

In some embodiments, the hold threshold comprises any one or more of:

a distance the mandrel has travelled or is yet to travel along the actuation distance, a distance the mandrel has travelled or is yet to travel along the actuation distance as a percentage of the actuation distance, and/or a time based on the distance the mandrel has yet to travel along the actuation distance and a rate of travel of the mandrel relative to the housing or known characteristics of the jar and an applied tension.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to". Where in the foregoing description, reference has been made to specific components or integers of the invention having known equivalents, then such equivalents are herein incorporated as if individually set forth.

The invention may also be said broadly to consist in the parts, elements and features referred to or indicated in the specification of the application, individually or collectively, in any or all combinations of two or more of said parts, elements or features, and where specific integers are mentioned herein which have known equivalents in the art to which the invention relates, such known equivalents are deemed to be incorporated herein as if individually set forth.

Further aspects of the invention, which should be considered in all its novel aspects, will become apparent from the following description given by way of example of possible embodiments of the invention.

BRIEF DESCRIPTION OF THE DRAWINGS

An example embodiment of the invention is now discussed with reference to the Figures.

FIGS. 3, 4 and 5 show the release mechanism in an engaged position, a fired position and disengaged position respectively.

FIGS. 6 and 7 show the transducer with a core of the transducer overlapping a secondary coil of the the jar in a cocked position and in a fired position respectively.

BEST MODES FOR CARRYING OUT THE INVENTION

The present invention relates to system and a jar for providing a real time measurement of the status of the jar at a surface wellsite. The jar status enables rig personnel to determine when the jar will fire.

Figure 1:
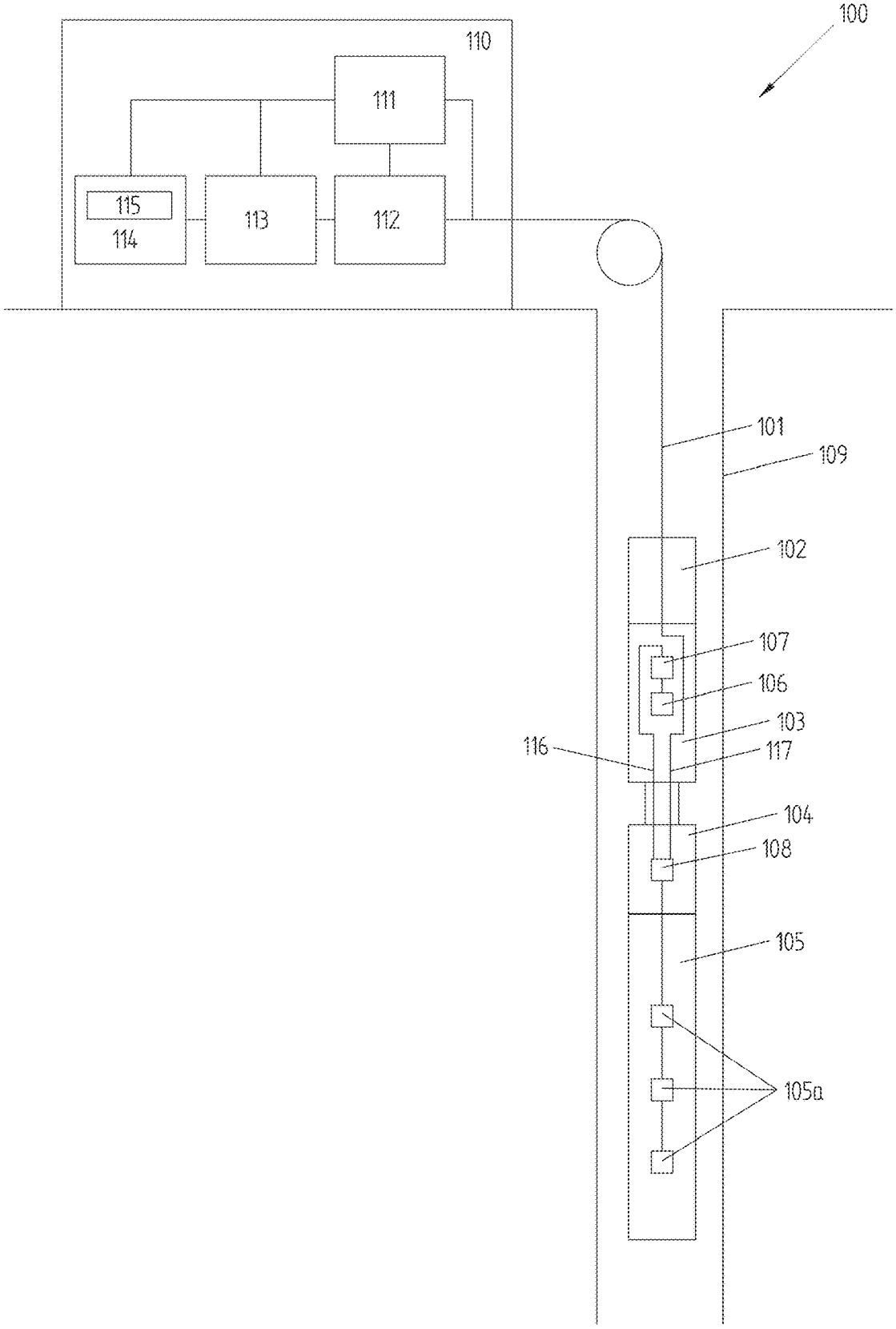
FIG. 1 is a block diagram of a system comprising a jar, the system and jar configured to provide a real-time measurement at the surface of when the jar will fire.

FIG. 1 illustrates a schematic diagram of a system according to an embodiment of the present invention. A jar 103 according to an embodiment of the present invention is connected in-line to a tool string 105. The tool string comprises one or more sensors and/or sampling tools 105*a* for logging data and/or collecting samples. The jar 103 may be connected at the top of the tool string 105 or in between upper and lower sections of a tool string. The jar 103 and connected tool string 105 may be connected to a conveyance system 101 via an upper connection sub 102. The upper connection sub 102 may be a logging head. The upper connection sub 102 may comprise various components or assemblies such as a tension sensor(s) and a conveyance release device as known in the art.

The jar 103 and tool string 105 are connected via the connection sub 102 and conveyance system 101 to a surface wellsite 110. The jar 103 and tool string 105 are run into and retrieved from a wellbore 109 drilled in a subterranean formation via the conveyance system 101 and wellsite equipment in a known way. For ease of explanation the conveyance system may be referred to herein as a 'wireline' however one skilled in the art will understand alternative wired conveyance systems may be used such as wired drill pipe or coiled tubing. Thus, it is to be understood that the term 'wireline' is not intended to be limiting.

The jar comprises a housing and a mandrel configured to move relative to the housing. When fired, the housing accelerates rapidly to collide with the mandrel to cause an impact. According to an embodiment of the present invention, the jar 103 comprises a transducer 106 configured to provide an electrical output dependent on the axial position of the mandrel relative to the housing. The transducer is therefore configured to provide a measurement of the relative axial position of the mandrel and the housing.

The jar 103 may include a signal conditioning module 107 for data communication. The signal conditioning module may comprise a digitizer and/or demodulator to digitize and/or demodulate the signal from the transducer. The data from the module 107 may be communicated to the surface via any known telemetry system. The data may be analogue or serial digital format. The data is provided real-time to give rig personnel real-time feedback on the relative position of the mandrel and housing and therefore a measurement of the jar status. The real-time feedback on the relative position of the mandrel and housing provides the rig personnel real-time feedback on when the jar will fire. The measurement allows the rig personnel to predict accurately when the jar will fire. In a preferred embodiment the measurement is a continuous real-time measurement.

The telemetry system may comprise a downhole modem and a surface modem for communication therebetween. The downhole modem may be provided as a component of the tool string such as a down hole telemetry module or may be provided with the jar assembly. For example, the tool string may comprise a telemetry cartridge 104 comprising a downhole modem 108. As illustrated in FIG. 1, the telemetry cartridge may be in the tool string below the jar 103. Data may be communicated from the jar transducer/signal conditioning module 106, 107 downwards via wiring 116 through the jar 103 to the tool string telemetry cartridge 104. The data is communication by the downhole modem 108 via wiring 117 that passes through the jar 103, connection-sub 102, the wireline 101 and interconnecting electrical connectors to the surface modem 112. Alternatively, data may be transmitted from the transducer or signal conditioning model directly via the wireline 101 in an analogue or serial data format.

Electrical power is provided to energize the transducer 106. Typically, power is provided by a surface power supply 111 via the wired conveyance system 101. The surface electrical power supply 111 may be a part of a rig or wellsite system 110 for powering the downhole equipment including the tool string. The power may be AC or may be DC with a waveform generator to provide an alternating excitation voltage to the transducer. The power supply may be provided via the telemetry cartridge 108 and/or via a combined power driver and signal condition module 107. Alternatively, the power may be provided directly via the wireline 111. In a further alternative embodiment, the power supply may comprise a battery provided with the down hole equipment, for example as part of the jar or the tool string.

The real-time axial position measurement may be received by a computer processor 113 at the surface wellsite. The processor 113 may be part of a rig or wellsite computer system for analysing and processing data collected from the downhole tool string equipment such as wireline logging and/or drilling equipment and the like. Alternatively, the processor may be located downhole, for example as part of the jar or tool string. One skilled in the art will understand the processor may be any suitable electronic processor and may comprise one or more processors and may be provided with the jar and/or topside equipment 110 and/or provided with the telemetry system/modems and/or provided remotely in wired or wireless communication.

The processor 113 may be loaded with an algorithm for processing the data communicated by the telemetry system. The processor 113 analyses or processes the axial position measurement data from transducer 106 to determine or provide a real-time measurement of the jar status, including prior to a jar firing event occurring.

The various components including signal conditioning module, telemetry system, power supply, processor and the like together form a Data Acquisition System for communicating the output from the transducer to the surface including any necessary processing for communication of the jar status to the rig personnel.

The measurement of the jar status is communicated to rig personnel, via a computer display screen or other visual or audio user interface 115 to provide a visual or audible indication. The user interface 115 may be part of a human machine interface 114. The human machine interface 114 may be part of a rig or wellsite system for interfacing with the downhole equipment during a downhole operation such as a wiring logging operation or other downhole operation.

Figure 2:
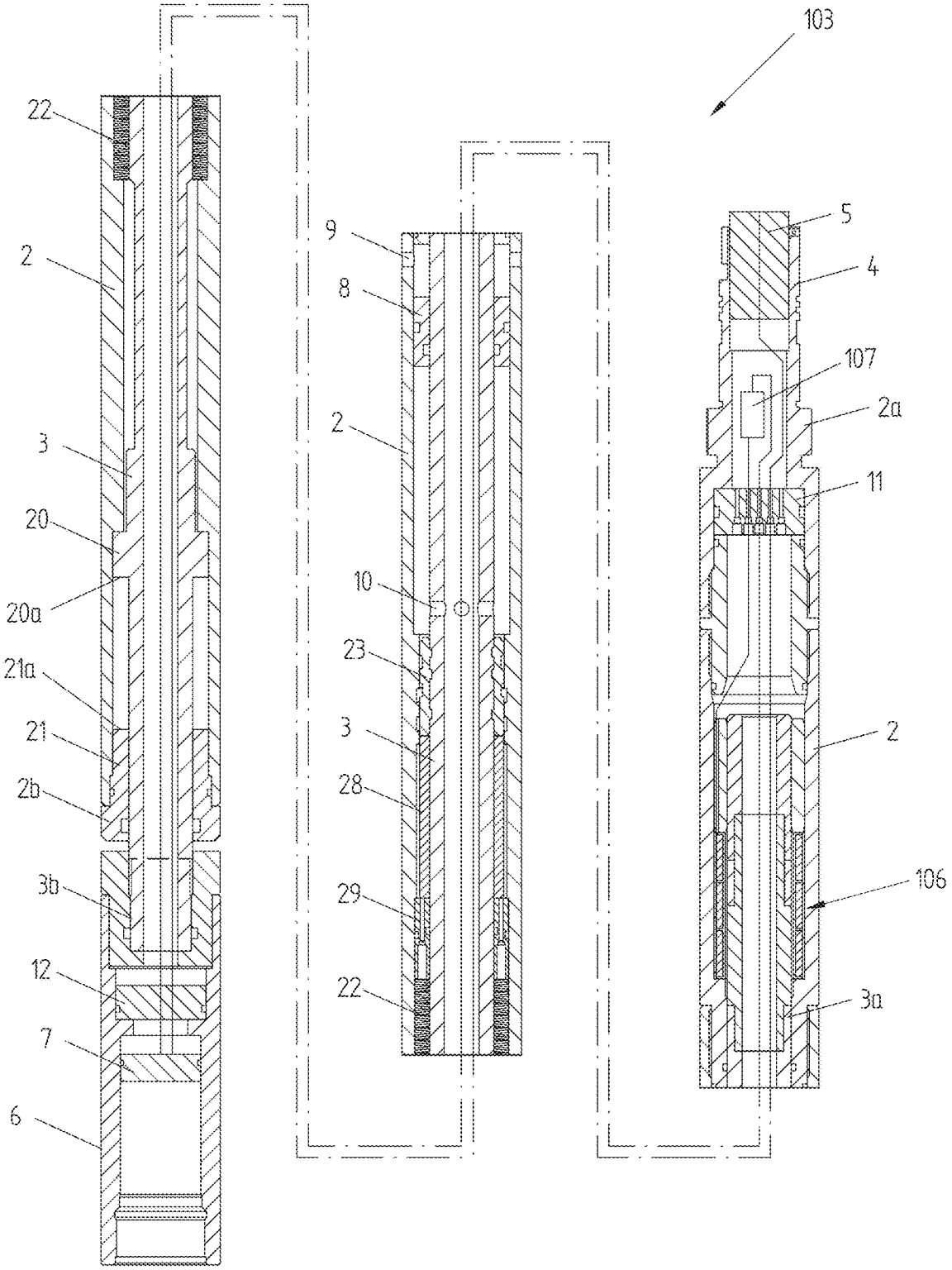
FIG. 2 is a schematic cross section representation of a jar according to one embodiment of the present invention. Due to its length the jar is illustrated in three sections, the three sections indicated as being joined together as one assembly by dashed lines.

FIG. 2 provides a sectional schematic view of an example jar 103 according one embodiment of the present invention for use in the above-described measurement system. The jar 103 comprises an outer housing 2 and an inner mandrel 3. The mandrel 3 is mounted to slide axially within the housing 2. A one end of the mandrel 3 extends from an end of the housing 2. The other end of the mandrel 3 is contained within the housing 2. Both the housing and the mandrel may each comprise many sections connected together, e.g. via threaded connections along its length. Such sections and threaded connections are omitted from FIG. 2 for simplicity.

The jar 103 is connected in-line to a tool string 105. In the illustrated embodiment, an upper end 2*a* of the housing 2 is connected to an upper part of the tool string or to the conveyance system 101 via the upper connection-sub 102. An upper end 3*a* of the mandrel is contained within the housing 2. A lower end 3*b* of the mandrel 3 extending from a lower end 2*b* of the housing 2 is connected to the tool string 105 below the jar 103.

For ease of explanation, the jar is described as having the housing 2 uppermost and the mandrel 3 lowermost, with the upper end 2*a* of the housing connected to the wireline 101 or upper part of the tool string, and the lower end 3*b* of the mandrel 3 connected to the tool string 105 below the jar. One skilled in the art will understand the jar 103 may be arranged with the housing connected to the tool string below the jar and the mandrel connected to the tool string above the jar or to the wireline. The terms upper and lower are used by way of explanation and are not intended to be limiting.

The upper end 2*a* of the housing 2 is provided with a connector 4 for mechanical and electrical connection to an upper portion of the tool string or the connection sub 102 connected to the wireline 101. The connector 4 includes an electrical connector 5 with one or more electrical pins or sockets (not shown). The lower end of the mandrel comprises a connector 6 for mechanical and electrical connection to the tool string below the jar. The connector 6 includes an electrical connector 7 with one or more electrical pins or sockets (not shown). The mandrel 3 is hollow providing a conduit for electrical conductors such as wires to pass along the length of the jar to electrically connect between the connectors 5, 7 to transfer data and power between the surface and the tool string 105.

The jar 103 may comprise a compensation piston 8 received in an annular space between the housing 2 and the mandrel 3. On one side of the compensation piston the housing comprises through holes 9 to allow ambient wellbore fluid and therefore pressure to enter the housing on that side of the piston 8. The annular space between the housing and the mandrel on the other side of the compensation piston is fluid filled, for example with hydraulic oil. Thus, the inside of the housing is pressure compensated via the compensation piston by the ambient wellbore pressure. Each end of the jar is provided with an electrical bulkhead 11, 12. One bulkhead 11 is fitted to the housing 2 at the upper end of the jar, and the other bulkhead 12 is fitted to the mandrel 3 and the lower end of the jar. Each electrical bulkhead 11, 12 comprises one or more pins/sockets to provide an electrical interface for wiring to pass through the jar. The bulkheads provide a pressure seal between the pressure compensated inside of the housing and mandrel and the upper and lower electrical connectors 5, 7. The upper and lower electrical connectors 5, 7 may be unpressurised.

The inside of the mandrel 3 is also pressure compensated by the compensation piston. The mandrel 3 comprises through holes 10 to fluidly connect the inside of the mandrel 3 to the pressure compensated inside of the housing 2. Thus, both the inside of the mandrel 3 and housing 2 are pressure compensated to the wellbore pressure via the compensation piston 8. Ambient wellbore pressure may be in the order of 5000 to 35,000 psi depending on wellbore fluid density and depth.

The mandrel 3 forms or comprises a hammer 20 and the housing 2 forms or provides a corresponding anvil 21. The hammer 20 is provided by an enlarged section of the mandrel 3 presenting a shoulder 20*a* to collide with the anvil 21. The anvil 21 is provided by a reduced section of the housing 2 presenting a corresponding shoulder 21*a* to receive the colliding hammer 20. In the illustrated embodiment the anvil 21 is provided by or at the end of the housing 2 through which the mandrel 3 extends.

One skilled in the art will understand every force has an equal and opposite force and depending which way around the jar is connected in a tool string (e.g. housing uppermost or mandrel upper most) the mandrel may provide the anvil and the housing the hammer. It should therefore be understood that the terms anvil and hammer may be used interchangeably and are not intended to be limiting.

FIG. 2 shows the jar in an unfired or 'cocked' state with the hammer 20 spaced from the anvil 21. Under normal operation where the tool string 105 and jar 103 are free to move in the wellbore, tension is applied to the jar due to the weight of the tool string 105 below the jar 103. The jar comprises a spring 22. When the jar is cocked, the spring 22 is captured between the housing and the mandrel to support the weight of the tool string 105 below the jar 103, as known in the art. For example, the spring may comprise a stack of Belleville washers or other spring(s) or spring elements. Tension applied to the jar causes the housing 2 to move axially relative to the mandrel 3, compressing the spring 22. With the jar connected inline between the wireline 101 and the tool string 105 below the jar, the spring 22 is partially compressed by the weight of the tool string 105 below the jar as the tool string is run into and out of the wellbore 109 under normal operating conditions.

The jar 103 comprises a release mechanism 23 to couple the mandrel 3 to the housing 2 and release the mandrel 3 from the housing 2. In an engaged position the release mechanism 23 couples the mandrel 3 to the housing 2 to transfer an applied tension therebetween, and in a disengaged position the release mechanism 23 releases the mandrel 3 from the housing 2. When the release mechanism is in the engaged position the jar is cocked, and when the release mechanism is in the disengaged position the jar is un-cocked.

In the engaged position, the release mechanism 23 couples the mandrel 3 to the housing 2 via the spring(s) 22 to compress the spring(s). Thus, tension applied to the jar by pulling on the ends 4, 6 of the jar is transferred to the springs 22 to compress the springs 22. Under normal operating conditions, the spring 22 is therefore partially compressed to support the weight of the tool string 105 below the jar.

If the tool string 105 becomes stuck in the well, the jar 103 may be fired by applying tension to the jar 103 to attempt to free and allow retrieval of the tool string 105. Tension is applied to the jar by applying tension to the wireline 101 extending between surface equipment and the jar 103 and stuck tool string 105. With the release mechanism 23 in the engaged position, the tension applied via the wireline 101 causes the housing 2 to move axially relative to the mandrel 3 to further compress the spring 22.

Continued application of tension above a threshold causes the spring 22 to continue to compress so that the housing 2 moves by an axial distance relative to the mandrel 3. Once the housing 2 has moved a sufficient axial distance relative to the mandrel 3, the release mechanism 23 is actuated to move from the engaged position to the disengaged position to release the housing 2. In the disengaged position, the release mechanism 23 releases the housing 2 so that the housing 2 is no longer coupled to the mandrel 3 via the spring 22. This allows the housing 2 to rapidly accelerate relative to the mandrel 3 under the tension applied by the wireline 101, causing the anvil 21 to collide with the hammer 20 to impart an impact force to the tool string 105 to free the tool string from its stuck position in the well 109.

Figure 3:
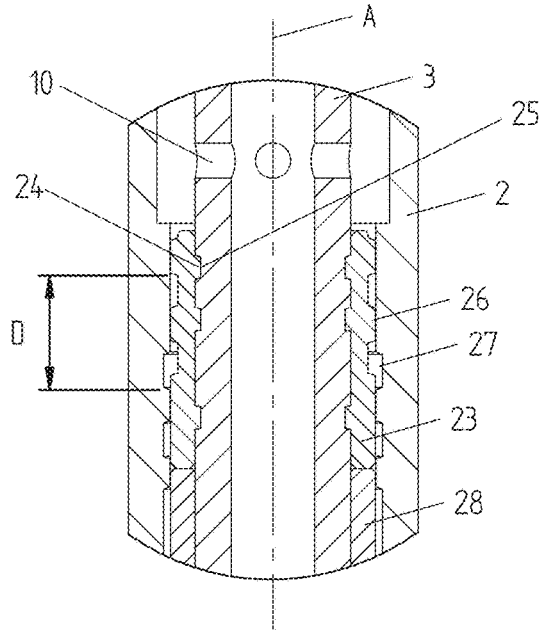
FIGS. 3 to 5 are schematic cross section representations of a release mechanism of the jar illustrated in FIG. 2.

By example, in the illustrated embodiment, the release mechanism comprises a collet or dog assembly 23 (herein 'dog'). The dog 23 may be as described in U.S. Pat. No. 10,151,165, the entire contents of which is incorporated herein by reference. With reference to FIG. 3, the dog 23 has a plurality of segments each with radially inward annular ribs 24 configured to fit into corresponding annular grooves 25 in the mandrel 3. As illustrated in FIGS. 2 and 3, in the engaged position, the ribs 24 are received in the grooves 25 in the mandrel 3 to axially lock the dog 23 to the mandrel 3 so that the dog 23 moves axially with the mandrel 3. When a tension above a threshold sufficient to compress the springs 22 is applied to the jar 103 via the wireline 101, the housing 2 moves relative to the mandrel 3, and the dog 23 engages a sleeve 28 which engages a piston 29 (refer FIG. 2) to also axially move the piston 29. Movement of the piston 29 compresses the spring 22. Thus, movement of the housing 2 relative to the mandrel 3 causes the release mechanism 23 to compress the spring 22 via the sleeve 28 and piston 29.

Figure 4:
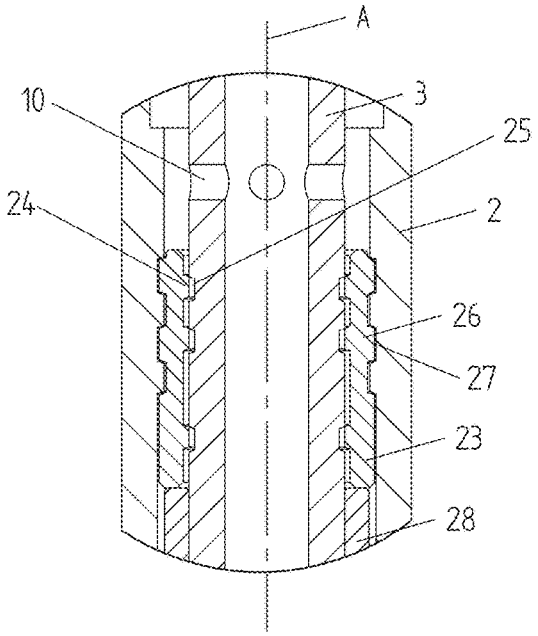
Figure 5:
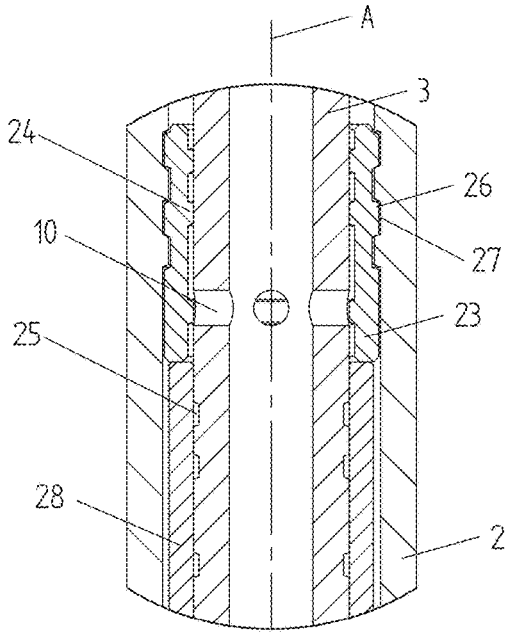
Figure 6:
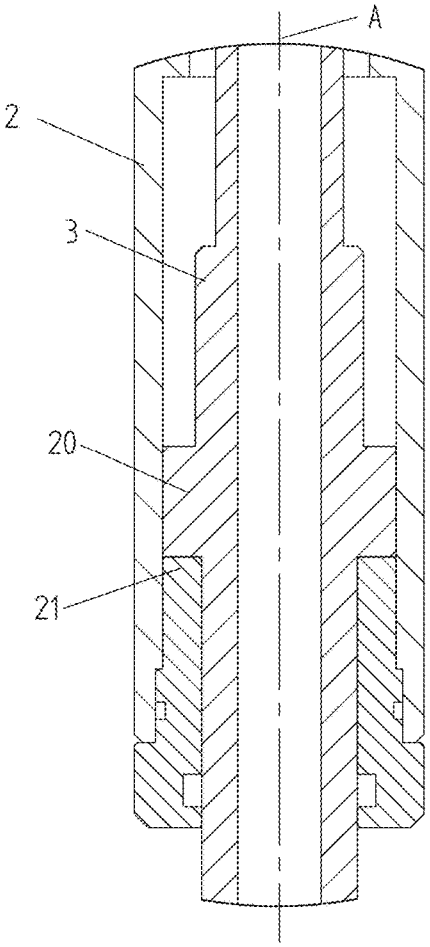
FIG. 6 is a schematic cross section representation of the hammer and anvil part of the jar shown in FIG. 2, with the hammer contacting the anvil.

The dog segments 23 each have radially outward annular ribs 26 configured to fit into corresponding annular grooves 27 in the housing 2. Once the dog has displaced axially by a sufficient distance (the actuation distance D, FIG. 3), the outer ribs 26 align with the housing grooves 27 and the segments of the dog 23 are moved radially outwards with the ribs 26 received in the housing grooves 27, as shown in FIG. 4. With the segments 23 moved radially outwards, the inner ribs 24 disengage from the grooves 25 in the mandrel 3, releasing the release mechanism 23 from the mandrel 3. This releases the housing 2 from engagement with the mandrel 3 via the spring 22, allowing the housing 2 to move rapidly relative to the mandrel 3 under action of energy stored in the tensioned and stretched wireline cable, accelerating the anvil 1 towards the hammer 20 to clause the collision therebetween. The jar 103 is fired the moment the release mechanism 23 releases the mandrel 3 causing the anvil 21 to accelerate towards the hammer 20 to strike the hammer and shock or 'jar' the tool string 105 free. FIG. 5 illustrates the release mechanism released from the mandrel with the anvil colliding with the hammer as shown in FIG. 6.

In the illustrated embodiment, the piston 29 comprises one or more fluid paths 30 each with a flow restrictor. For the piston 29 to move to compress the spring 22, the hydraulic fluid in the space between the housing 2 and mandrel 3 must flow through the piston 29 from the spring side of the piston to the release mechanism side of the piston 29. The flow of hydraulic fluid slows down the movement of the piston 29 and dog 23 and therefore the time taken to fire the jar 103 when tension is applied to the jar 103. This mechanism provides a hydraulic time delay.

The above jar configuration is provided by way of example. The present invention may be applied to any jar having a mandrel that moves relative to a housing to collide under the action of an applied tension. The present invention may be particularly useful in a jar that has a release mechanism actuated to fire the jar by relative movement between the housing and mandrel by a set axial distance—the actuation distance. For example, the present invention may be applied in a mechanical jar, wherein a release mechanism is actuated by movement of the housing relative to the mandrel to trigger the release mechanism to decouple the mandrel from the housing.

According to the present invention, the jar 103 comprises a transducer 106 configured to provide a measurement of the relative axial position of the mandrel and the housing. The transducer 106 is configured to provide a continuous measurement of the relative axial position of the mandrel 3 and housing 2. The relative axial position of the mandrel 3 and housing 2 can be used together with the actuation distance D to determine when the jar 103 is going to fire.

For example, a typical jar actuation distance D may be approximately 1 to 2 inches, or about 25 mm to 50 mm. In the above-described example jar, the release mechanism must move about 2 inches from a jar 'cocked' position to a jar release position (i.e. D=2 inches). In the cocked position, the hammer 20 is at or near to a beginning of its stroke with the springs supporting the weight of the jar and tool string below the jar. In the release or firing position, the release mechanism 23 is free to release the mandrel 3, e.g. in the illustrated embodiment, in the release position the dog 23 is positioned to enter the grooves 27 in the housing 2 to release from the mandrel 3. The transducer 106 may be calibrated so that the relative position between the mandrel 3 and housing 2 with respect to the cocked and release position is known. For example, when the jar is in the 'cocked' position with the hammer at the beginning of its stroke, the relative position between the mandrel and housing is 2". When the mandrel has moved 2" relative to the housing to the release position, the relative position of the mandrel and housing is 0" and the release mechanism releases from the mandrel to fire the jar. Thus, at a relative position of 1" the jar is 50% along the actuation distance to cause the jar to fire, and at a relative position of 0.5" the jar is 75% along the actuation distance.

The relative axial position of the mandrel and housing therefore provides a measurement of how far the mandrel must move relative to the housing to cause the jar to fire, and therefore when the jar is going to fire. Thus, the system may be configured to provide a measurement at the surface of the jar status based on the measured axial position. The jar status provides a measurement of when the jar will fire based on the measured axial position and the actuation distance.

The measurement of jar status or when the jar will fire may be one or more of:

The distance the mandrel has travelled or is yet to travel along the actuation distance, The distance the mandrel has travelled or is yet to travel along the actuation distance as a percentage of the actuation distance, A time based on the distance the mandrel has yet to travel along the actuation distance and a rate of travel of the mandrel relative to the housing or known jar characteristics for a given tension applied to the jar. A time based measurement may be provided as a countdown timer.

The measurement may be displayed graphically to the rig personnel, for example as a graph, chart or a counter displaying an incrementing or decrementing distance, percentage, and/or time. The graph, chart or counter may update in real-time based on the relative position of the mandrel and housing. In a preferred embodiment, the measurement is a continuous real-time measurement, i.e. the measurement is continuously updated and communicated to the user, providing the user real-time feedback and understanding of the status of the jar and when the jar is going to fire.

Alternatively, or additionally, the system may provide one or more pre-emptive real-time discrete warnings that the jar is going to fire, such as a visual and/or audible alarm or alarms. A series of pre-emptive warnings may be provided. For example, a warning may sound at 50%, 75%, 80%, 85% and 90% of travel along the actuation distance, or at time intervals (e.g. 1-minute intervals) prior to the jar firing based on the relative position and a rate of travel along the actuation distance.

Figure 7:
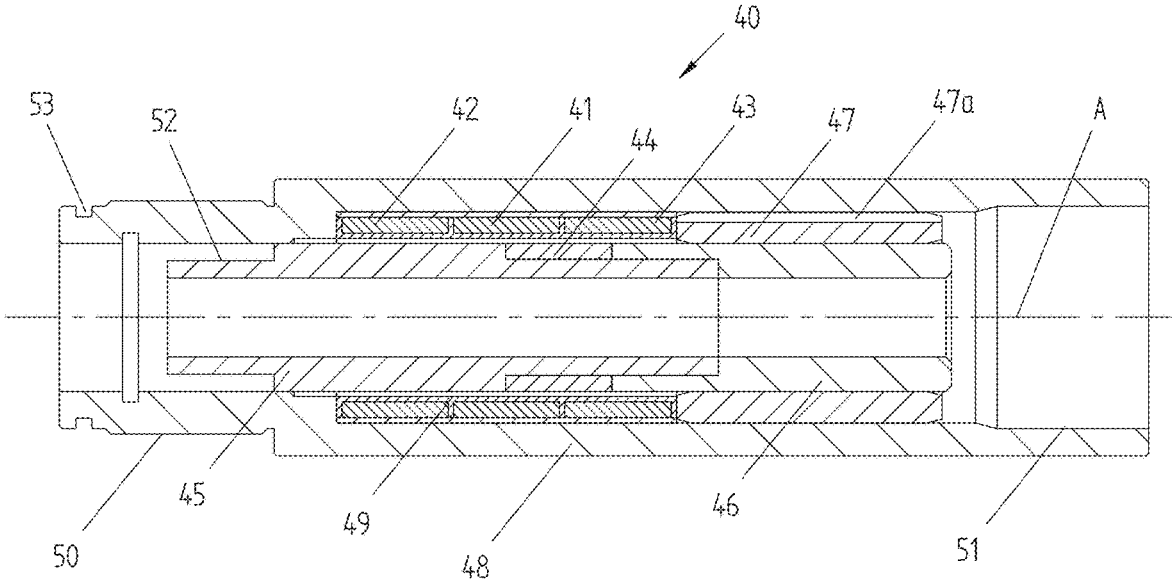
FIGS. 7 and 8 are a schematic cross section representations of a transducer for a jar or other downhole tool.
Figure 8:
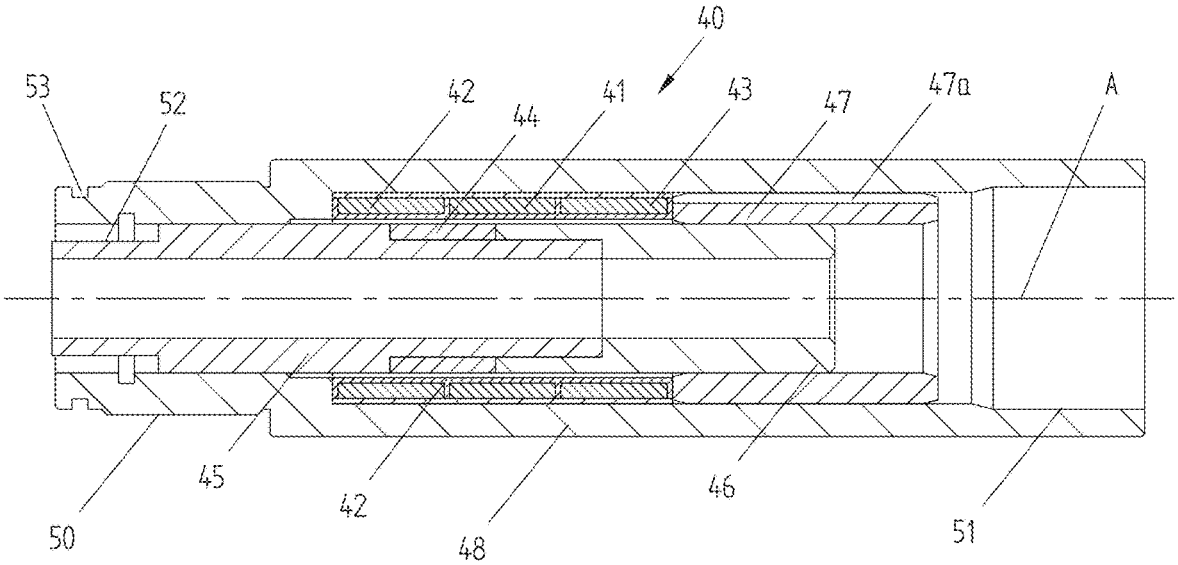
Figure 9:
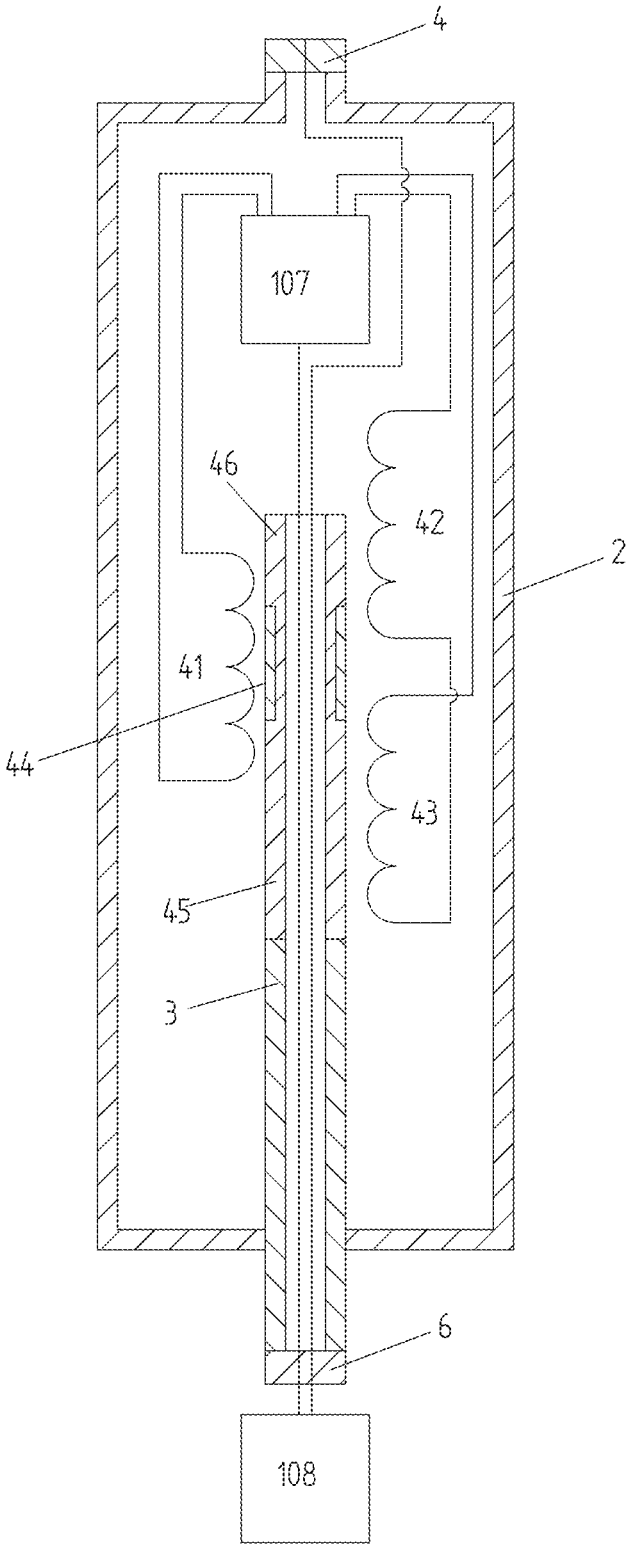
FIG. 9 is a schematic diagram of a LVDT transducer in a jar.

With reference to FIGS. 7-9, in the illustrated embodiment, the transducer is a linear variable differential transducer 40. The LVDT 40 comprises three coils 41, 42, 43 mounted to the housing 2. The coils 41, 42, 43 are wound on a non-conductive bobbin 49. The coils comprise a central primary winding 41 and two secondary windings 42, 43. The secondary windings are wound in series but in opposite directions. The LVDT therefore may have a total of four input/output wires; two wires for the primary winding and two wires for the secondary windings. Alternatively, the LVDT may have six input/output wires, with the secondary wires combined at a sensor electronics module or post digitization.

A portion of the mandrel 3 passes through the coils. A central longitudinal axis A of the mandrel is colinear with a central longitudinal axis of a bore of the coils 41, 42, 43. A magnetic permeability material 44 is fixed to the mandrel 3 to be received within and move axially with the mandrel within the bore of the coils 41, 42, 43. The magnetic permeable material provides a magnetic permeable core 44 positioned within the coils 41, 42, 43. In the illustrated embodiment, the magnetic permeable material 44 is a sleeve provided to an outside of the mandrel.

An alternating/sinusoidal voltage is applied to the primary winding 41 to generate a magnetic flux. For example, the voltage may be between 3- and 10-Volts peak-to-peak. The core 44 couples the magnetic flux to the secondary windings 42, 43 to induce a voltage in each of the secondary windings. The position of the core with respect to the secondary windings determines the amount of voltage induced in each. The differential voltage output between the two secondary windings 41, 42 is proportional to the position of the core 44. As the mandrel moves, the core 44 moves with the mandrel relative to the coils to generate an electrical signal from the transducer that is dependent on the axial position of the core and mandrel, thus providing a measurement of the relative position of the mandrel 3 with respect to the housing 2.

The magnetic permeable material 44 may be any material that has a high magnetic relative permeability (e.g. more than 50000H/m). Example materials include ferromagnetic materials, Mu-metal™, ferrite, permalloy, Metglas™, some stainless steels and iron alloys. An example magnetic permeable material 44 is a nickel-iron alloy for example Mu metal, e.g. to ASTM A753 Alloy 4. An example alloy is 80% Nickel, 12-15% iron and 5% molybdenum. The magnetic sleeve may have a radial thickness of about 0.2 mm to 10 mm.

The mandrel 3 may be formed from a plurality of mandrel sections connected end-to-end. In the illustrated embodiment, the mandrel comprises a non-magnetic portion 45, 46 extending through the coils 41, 42, 43. The magnetic permeable material 44 is mounted to the non-magnetic portion 45, 46 of the mandrel 3. The non-magnetic material is preferably made from a low magnetic permeable metal, e.g. with a magnetic permeability of around 1, for example Inconel, titanium or aluminium.

The non-magnetic portion 45, 46 of the LVDT core may be considered a portion of the mandrel 3 that extends through the LVDT windings. In other words, a portion of the mandrel provides the non-magnetic portion of the LVDT core. The core 44, 45, 46 comprises a non-magnetic hollow cylinder 45, 46 with a magnetic permeable material 44 attached to the non-magnetic cylinder. The magnetic permeable material 44 is attached to an outside diameter of the non-magnetic cylinder. The non-magnetic cylinder may have an internal diameter substantially the same as an ID of the mandrel. For example, the ID of the cylinder core may be about 10 mm to 35 mm, or about 15 mm to 23 mm, or about 20 mm to 25 mm (about 0.75 inch-1 inch). The non-magnetic cylinder may have an external diameter substantially the same as an external diameter of the mandrel. For example, the OD of the core may be about 30 mm to 55 mm, or about 35 mm to 50 mm, or about 40 mm to 45 mm (about 1.5 inch to 1.75 inch). The core and magnetic permeable material and the coils should have a sufficient axial length to provide a signal proportional to the relative position of the mandrel and housing over a sufficient axial stoke to provide a continuous incremental measurement of the relative axial position between the housing and mandrel. For example, the core and magnetic permeable material and the coils should have a sufficient axial length to provide a signal proportional to the relative position of the mandrel and housing over at least the actuation distance. The raw signal or signals from the secondary coil or coils will be sinusoidal which is amplitude modulated or 'modulated' in proportion to the relative axial position, so the signal from the LVDT will be proportional to the relative axial position after demodulation (removal of the sinusoid).

In the illustrated embodiment, the non-magnetic portion of the mandrel is provided in two parts 45, 46. One part 45 has a reduced diameter to receive the magnetic permeable material thereon. The two parts 45, 46 are assembled together, e.g. by mating threads, to secure the magnetic material 44 therebetween. The non-magnetic portion is connected to an end of the mandrel 3, e.g. by threaded connection. The core is connected in-line with the mandrel.

As noted earlier, the mandrel is hollow providing a conduit for electrical communication through the jar. The LVDT hollow cylindrical core provides a conduit for electrical conductors and/or hydraulic lines to pass through the LVDT. The hollow cylindrical LVDT core together with the hollow mandrel forms the electrical conduit extending though the jar. The non-magnetic cylinder portion 45, 46 of the core may be formed from an electrically conductive material. The non-magnetic cylinder portion 45, 46 of the core may form a faraday shield to prevent the electrical carrying conductors passing through the LVDT and jar from interfering with the LVDT signal. For example, the low magnetic permeable core is formed from a stainless steel or alloys such as Inconel, Monel and the like. As noted earlier, the inside of the mandrel 3 is fluid filled, e.g. with hydraulic fluid. Thus, the bore of the cylindrical core is also fluid filled. The fluid is a low magnetic permeability material.

The jar comprises electrical conductors passing through the conduit of the mandrel and core. The conductors extend between the upper and lower connectors 4, 5. With reference to the schematic wiring diagram of FIG. 9, the electrical conductors are configured to carry a signal or data from the transducer to the lower connector, to pass from the jar to the telemetry module. The electrical conductors are configured to carry associated signal or data from the bottom connector to the upper connector for transmission to the surface. As described earlier, the jar may comprise a transducer signal conditioning module 107. The signal/data from the transducer 106 may be communicated from the conditioning model 107 via the electrical conductors passing downwards through the electrical conduit through the jar, including through the cylindrical core of the LVDT, via connector 6 to the downhole modem 108 of the telemetry cartridge 104. The data is transmitted from the downhole modem 108 via electrical conductors back up through the electrical conduit through the jar 103 from the bottom connector 6 to the upper connector 4, including through the cylindrical core of the LVDT, to the surface via the upper connection sub 102 and wireline 101. The earlier described signal conditioning module 107 may also comprise a driver circuit to power the primary winding 41. The electrical conductors may be configured to carry power from the telemetry module to the driver circuit and transducer. By example, the signal conditioning module may comprise a Texas Instruments PGA970 integrated system-on-chip LVDT sensor-signal conditioner.

With reference to FIGS. 7 and 8, the LVDT may comprise a bush or sleeve 47 for supporting a free end of the mandrel/core 45, 46 to slide therein. The bush or sleeve may comprise a channel 47*a* or duct to route wires from the coils and LVDT to avoid contacting the moving mandrel. For example, the sleeve 47 has a length sufficient so that the core does not substantially extend from the sleeve when at an extent of its travel. The sleeve may be sacrificial, to be replaced once worn. The sleeve may be formed from a plastic material, such as PEEK or other suitable engineering plastic material.

The LVDT may be provided as a retrofittable assembly 40. The assembly 40 may comprise an outer housing 48 for connection to the housing 2 of a jar. Once connected, the housing 48 forms a section or portion of the housing of the jar. Each end of the housing 48 may be connected within the jar housing 2 by a threaded connection 50, 51. For example, each end of the housing 48 may be provided with a male 50 or female 51 thread to mate with a corresponding thread on the tool housing.

Similarly, the cylindrical core 45, 46 may be connected within or to an end of the mandrel 3 of the jar. Once connected, the core 45, 46 may form a section of the mandrel 3 of the jar. The core 45, 46 may be connected to the jar mandrel 3 by a threaded connection 52. For example, the core may be provided with a male or female thread to mate with a corresponding thread at the end of the mandrel. To retrofit the LVDT to an existing jar may require a thread to be cut on the mandrel, e.g. to an end of the mandrel. The threaded connections 50, 51, 52 may be provided with one or more seal grooves to receive a seal such as an o-ring to form a fluid tight seal between the transducer housing and/or core and the jar housing and mandrel, for example seal groove 53 The LVDT is provided by way of example. Other sensor configurations may be possible, for example, potentiometric Linear Position Sensors, Magnetostrictive Linear Position Sensors, Capacitive Linear Position Sensors, Optical Linear Encoders, Inductive Linear Position Sensors, Ultrasonic Linear Position Sensors, Hall-Effect Based Linear Sensor. However, the transducer is configured to provide a continuous incremental measurement of the axial position of the mandrel relative to the housing. Continuous incremental measurement allows for continuous tracking of the relative axial position of the mandrel (e.g. over the actuation distance) to provide the user with accurate and continuous feedback on the jar status and when the jar is going to fire. Continuous real-time measurement provides data at a sample rate of many data points per second or many data points per minute. For example, the sample rate may be 10, 20, 30, 40, 50, 60 or more samples per minute, or 10, 20, 30, 40, 50, 60 or more samples per second. Continuous incremental measurement means relative axial position is measured in small amounts such that small changes in the axial position, including both increasing and decreasing changes, are measured. In other words, continuous incremental measurement means gradual changes in relative axial position are continuously measured. For example, the transducer is configured to measure changes in the relative axial position of a millimetre or less than a millimetre (i.e. fractions of a millimetre).

The jar status may be communicated to a user such as rig personnel in real-time as a continuous incremental measurement. For example, the measurement of the relative axial position may be provided as the jar status, or any one or more of other values described above provided as an incremental measurement in real time. Since the measurement is provided incrementally and continuous in real time the rig personnel can accurately determine (forecast) when the jar will fire.

Alternatively, or additionally, while the transducer may be configured to provide a continuous incremental measurement, the measurement of the jar status may be communicated to a user in the form of one or more discrete warnings as described earlier.

Alternatively, the transducer may comprise one or more binary transducers providing an on/off, true/not true output. However, the system is arranged to provide a real time measurement of when the jar will fire. For example, a binary output sensor may detect when the mandrel is a certain distance or proportion along the actuation distance to allow for a warning to be provided. The warning may be understood to indicate the jar will fire within a known time period based on the relative position of the mandrel and housing and known characteristics for a given tension applied to the jar. Multiple binary sensors may be spaced axially apart to detect the relative position of the mandrel and housing as the relative position moves along the actuation distance.

While the invention is particularly useful in a jar with a release mechanism actuated by axial displacement of the mandrel relative to the housing by an actuation distance, the invention may be useful in any jar or downhole device that has an inner mandrel that moves relative to an outer housing, or where one part moves relative to another part and where feedback of the relative axial position provides an indication of a state of the tool. The invention may be used to provide an indication of jar status in relation to a stoke of the hammer to impact the anvil. For example, the measurement may provide a confirmation to rig personnel that the jar has re-cocked after firing.

In preferred embodiments, the measurement of the relative position of the mandrel and housing is provided continuously and in real-time so that rig personnel can assess when the jar will fire. The measurement may be configured to provide an indication of the status of the jar, e.g. cocked/not-cocked, fired/not-fired.

The predictive nature of the measurement allows for control of how a jar firing event is managed and controlled. For example, a high tension may be applied to a jar to attempt to free a stuck tool string. The real-time measurement of jar status and therefore when the jar will fire provides an opportunity for rig personnel to reduce the tension prior to the jar firing, to prevent the jar firing event occurring at the high tension, thus avoiding damage to sensitive tool string components. If the tool-string remains stuck after application of the high tension, a jarring event may be subsequently initiated at a reduced tension.

Figure 10:
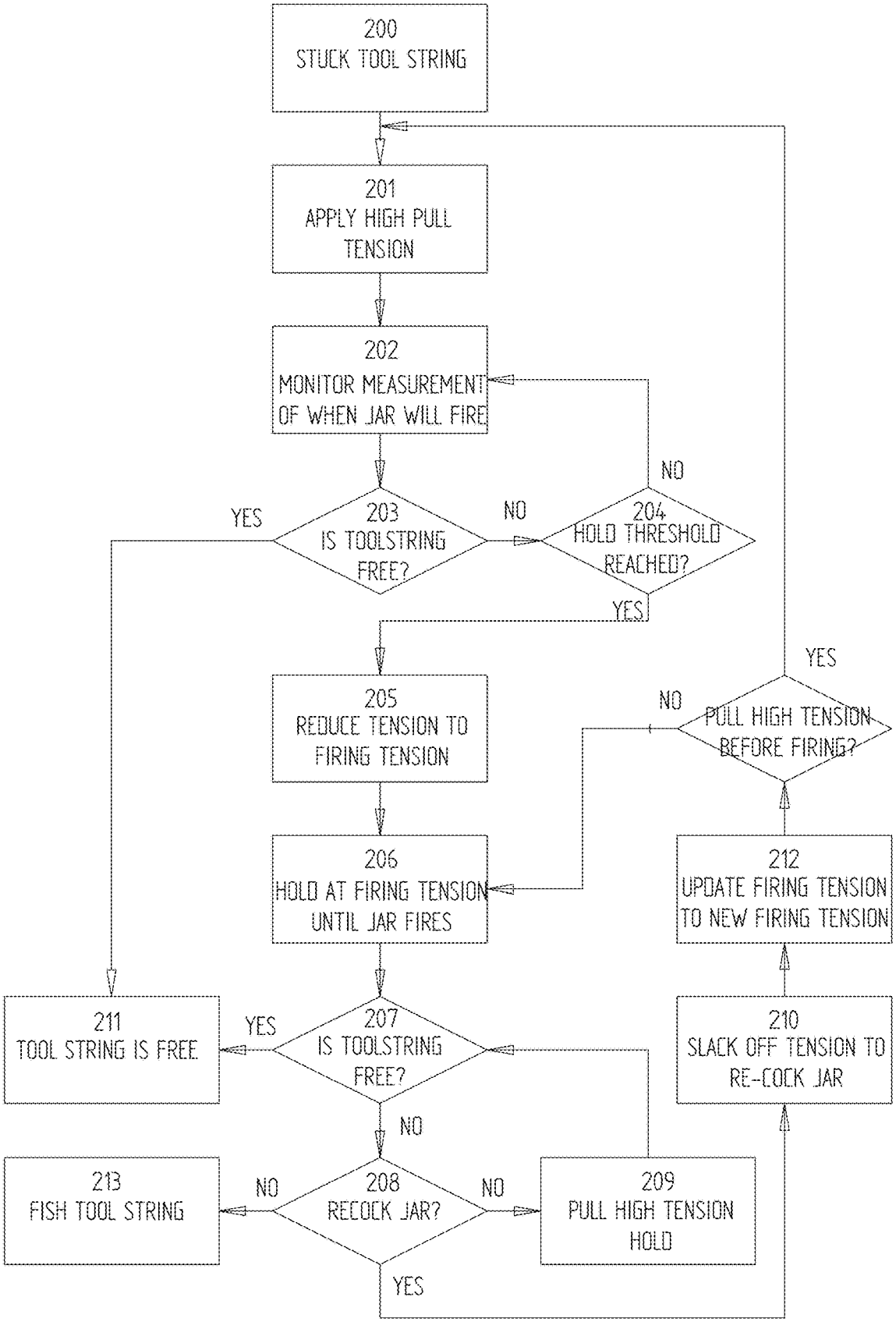
FIG. 10 is a block diagram of a method for firing a jar to free a stuck tool string.

A method for firing a jar using a jar and system as described herein is illustrated by the flow diagram of FIG. 10. Should a tool string become stuck in a well, at step 201 a high pull tension may be applied to the tool string comprising a jar as described above. The pull tension may be a maximum rated tension set by the wireline or other component in the tool string, such as the logging head. For example, a tension of 10,000 pounds or more may be applied.

While the high pull tension is applied, at step 202, rig personnel monitor the measurement of jar status and therefore when the jar will fire provided by the system 100. At steps 203 and 204, the pull tension is held until the tool string becomes free or until a hold threshold is reached. The hold threshold may be for example, a time limit, e.g. 5 minutes to fire, or a distance threshold such as a mandrel and housing relative position of 80% of the actuation distance. Other, alternative, hold thresholds may defined. If the hold threshold is reached and the tool string is still stuck, then at step 205 the tension applied to the jar is reduced from the high pull tension to a firing tension. For example, an acceptable firing tension may be 4000-6000 pounds. At step 206 the firing tension is maintained until the jar fires. At step 206 the rig personnel can continue to monitor the measurement of when the jar will fire and will therefore be aware of when the jar has fired.

At step 207, if tool string is free further steps can be taken at step 211 to retrieve the tool string from the wellbore. If the tool string is not free after firing the jar, and it is possible to re-cock the jar, at step 208 rig personnel may decide to re-cock the jar to allow for a refiring of the jar. Alternatively, at step 208 the rig personnel may decide not to re-cock the jar and at step 209 apply a high pull tension to the jar to again attempt to free the jar, prior to trying to refire the jar. For example, since the jar is not cocked, rig personnel may decide to increase pull and hold the cable for an extended time (e.g. 30 min to several hours or longer) at a high pull tension (e.g. maximum allowable tension). This may free the tool string without refiring the jar.

If the decision is made to re-cock and refire the jar, at step 210 the tension applied to the tool string is slacked off to re-cock (reset) the jar. The measurement of the jar position may be monitored to provide an indication of when the jar has re-cocked.

Once the jar has been confirmed as re-cocked, the procedure from step 201 can then be repeated. However, when repeating the procedure after firing the jar, at step 201 the pull tension may optionally be updated to a new (e.g. higher or lower) pull tension. Alternatively, if a pull tension has already been applied at step 209 after firing and before re-cocking the jar, steps 201 to 205 may be omitted.

When refiring the jar, the firing tension may be updated from the previously applied firing tension to a new firing tension, as shown at step 212. For example, the new firing tension may be higher than the previous firing tension. Again, by example, the new firing tension may be the previous firing tension+500 pounds. At step 206 the new (e.g. higher) firing tension is held on the tool string until the jar fires at the new firing tension.

The procedure may be repeated with progressively higher firing tensions up to a maximum allowable firing tension. In this way, the firing of the jar can be carried out in a controlled manner with a high pull force applied in between progressively higher jar firing tensions. This method may increase the chance of freeing the tool string while mitigating potential damage to the tool string caused by firing at a high tension when a lower tension may have been sufficient to free the tool string.

If, after performing the procedure 200 the tool string remains stuck, finally rig personnel may decide to fish the tool string (step 213)

The system 100 provides a conclusive indication at surface of jar status and thus eliminates the risk of unintentionally firing the jar at a high tension.

Although this invention has been described by way of example and with reference to possible embodiments thereof, it is to be understood that modifications or improvements may be made thereto without departing from the spirit or scope of the appended claims.

The invention claimed is:

1. A jar for providing an impact to a tool string stuck in a wellbore, the jar comprising:

a housing and a mandrel configured to move relative to the housing, and a release mechanism actuatable to fire the jar to cause the housing and mandrel to collide by the action of an applied tension to cause an impact to the tool string, and a transducer configured to measure the axial position of the mandrel relative to the housing to allow for a real-time measurement of the jar status at the surface based on the measured axial position, and wherein the transducer is a linear variable differential transformer comprising:

a primary coil and two secondary coils mounted to the housing, and a core comprising a magnetic permeability material fixed to the mandrel and received within a bore of the coils to move axially with the mandrel therein, the core comprising a non-magnetic portion fixed to the mandrel and the magnetic permeable material mounted to the non-magnetic portion, wherein the mandrel is hollow, and wherein the non-magnetic portion of the core is a hollow cylinder connected in-line with the mandrel, an inside of the mandrel and the core providing a conduit for electrical conductors to pass through the jar.

2. A jar as claimed in claim 1, wherein the release mechanism is configured to be actuated by axial displacement of the mandrel relative to the housing by a predetermined actuation distance, and the transducer is configured to measure the axial position of the mandrel relative to the housing to allow for a real-time measurement at the surface of the jar status based on the measured axial position and the actuation distance.

3. The jar as claimed in claim 1, wherein the transducer is configured to continuously and incrementally measure the axial position of the mandrel relative to the housing.

4. The jar as claimed in claim 1, wherein the non-magnetic hollow cylinder forms a faraday shield to prevent electrical carrying conductors passing through the transducer from interfering with a signal from the transducer.

5. The jar as claimed in claim 1, wherein the jar comprises a compensation piston and an inside of the housing, mandrel and core is fluid filled, and the fluid is pressure compensated to an external ambient pressure by the compensation piston.

6. A system for providing an impact to a tool string stuck in a wellbore, the system comprising:

a jar as claimed in claim 1, a data acquisition system to provide communication between the jar and a surface wellsite, and a surface user interface to communicate the real time measurement of the jar status at the surface based on the measured axial position.

7. The system as claimed in claim 6, wherein the jar release mechanism is configured to be actuated by axial displacement of the mandrel relative to the housing by a predetermined actuation distance, and the system is configured to provide the real-time measurement of the jar status based on the measured axial position and the actuation distance.

8. The system as claimed in claim 7, wherein the system is configured to provide the real-time measurement of the jar status based on the measured axial position, a rate of axial travel of the housing relative to the mandrel and the actuation distance.

9. The system as claimed in claim 7, wherein the measurement of the jar status is or comprises one or more of:

a distance the mandrel has travelled or is yet to travel along the actuation distance, a distance the mandrel has travelled or is yet to travel along the actuation distance as a percentage of the actuation distance, and/or a time based on the distance the mandrel has yet to travel along the actuation distance and a rate of travel of the mandrel relative to the housing or known characteristics of the jar and an applied tension.

10. The system as claimed in claim 6, wherein the jar status comprises any one or more of jar fired, jar not-fired, jar cocked, jar not-cocked.

11. The system as claimed in claim 9, wherein the system is configured to provide the jar status as a continuously incrementing real time value and/or one or more real-time discrete visual or audible warning.

12. The system as claimed in claim 11, wherein the one or more warning is based on a distance and/or time threshold determined from i) when the mandrel has moved a portion of an actuation distance and/or ii) a time period based on a distance of travel of the mandrel relative to the housing, the actuation distance and a rate of travel of the housing relative to the mandrel.

13. A method for firing a jar, the method comprising:

i) providing a system as claimed in claim 6, and if the tool string becomes stuck in the wellbore:

ii) applying a pull tension to the jar, iii) monitoring the real time measurement of the jar status to determine when the jar will fire, and continuing to apply the pull tension until the tool string is free or a hold threshold is reached, and iv) if the tool string is not free and the hold threshold is reached, applying a firing tension to the jar, wherein the firing tension is less than the pull tension, and v) firing the jar at the firing tension.

14. The method as claimed in claim 13, wherein if the tool string is not free after firing, then the method further comprises applying a pull tension to the jar without re-cocking the jar.

15. The method as claimed in claim 13, wherein if the tool string is not free after firing, the method further comprises:

vi) re-cocking the jar, vii) determining an updated firing tension, and viii) firing the jar at the updated firing tension.

16. The method as claimed in claim 15, wherein the updated firing tension is higher than a previous firing tension.

17. The method as claimed in claim 15, wherein if the tool string is not free after firing at the updated firing tension, the method further comprises refiring the jar at progressively higher firing tensions up to a maximum allowable firing tension or until the tool string is free.

18. The method as claimed in claim 13, wherein the hold threshold comprising any one or more of:

a distance the mandrel has travelled or is yet to travel along the actuation distance, a distance the mandrel has travelled or is yet to travel along the actuation distance as a percentage of the actuation distance, and/or a time based on the distance the mandrel has yet to travel along the actuation distance and a rate of travel of the mandrel relative to the housing or known characteristics of the jar and an applied tension.

* * * * *